US006318723B1

(12) United States Patent
Kurita

(10) Patent No.: US 6,318,723 B1
(45) Date of Patent: Nov. 20, 2001

(54) GAME CARD

(75) Inventor: Masahiro Kurita, Tokyo (JP)

(73) Assignee: Institute of SRS, Tokyo (JP)

( * ) Notice: Subject to any disclaimer, the term of this patent is extended or adjusted under 35 U.S.C. 154(b) by 0 days.

(21) Appl. No.: 09/297,022

(22) PCT Filed: Nov. 4, 1997

(86) PCT No.: PCT/JP97/04000

§ 371 Date: Apr. 23, 1999

§ 102(e) Date: Apr. 23, 1999

(87) PCT Pub. No.: WO98/19757

PCT Pub. Date: May 14, 1998

(51) Int. Cl.[7] ..... A63F 1/00
(52) U.S. Cl. ..... 273/308; 273/157 R; 273/292
(58) Field of Search ..... 273/308, 292, 273/157, 157 R, 302, 153 R, 156

(56) References Cited

U.S. PATENT DOCUMENTS

| | | | |
|---|---|---|---|
| 3,333,351 | * | 8/1967 | Williams . |
| 4,361,328 | * | 11/1982 | Stein . |
| 5,100,154 | * | 3/1992 | Mullins . |
| 5,490,676 | * | 2/1996 | Rake . |
| 5,562,550 | * | 10/1996 | Chartrand . |
| 5,826,878 | * | 10/1998 | Kiyosaki . |
| 5,838,302 | * | 11/1998 | Kuriamma . |
| 5,909,687 | * | 6/1999 | Tapper . |

FOREIGN PATENT DOCUMENTS

| | | | |
|---|---|---|---|
| 2460145 | * | 1/1981 | (FR) . |
| 2602151 | * | 2/1988 | (FR) . |
| 6-71009A | | 3/1994 | (JP) . |
| 7-213679A | | 8/1995 | (JP) . |

OTHER PUBLICATIONS

Microfilm of the specification and drawings annexed to the request of Japanese Utility Model Application No. 32568/1985 (Laid–open 148384/1986) K.K. Yuni Dezain) Sep. 12, 1986.

* cited by examiner

*Primary Examiner*—Benjamin H. Layno
*Assistant Examiner*—V K Mendiratta

(57) ABSTRACT

A game card for a sympathetic game or the like, enables a plurality of players to enjoy a psychological sympathetic game. The card includes a positional specific information entering space with a frame, a player's specific information entering space with a frame, a digital information entering space with a frame and an analog information entering space with a frame. The game card is used for playing a game in which the game cards are dealt to a plurality of players one by one. Each player enters a positional information for specifying a position of the player in the positional specific information entering space, a player's specific information for specifying the player in the player's specific information entering space, an information selected from among a plurality of predetermined written information in the digital information entering space and optional information determined by the player in the analog information entering space. The game cards are collected and arranged in accordance with the positional information entered in the positional specific information entering space. A degree of sympathy between one digital information entered in one game card and another digital information entered in another game card arranged around the one game card, and a degree of sympathy between one analog information entered in one game card and another analog information entered in another game card which is arranged around the one game card, are estimated by giving points.

10 Claims, 3 Drawing Sheets

GAME CARD

This application is the national phase under 35 U.S.C. §371 of PCT International Application No. PCT/JP97/04000 which has an International filing date of Nov. 4, 1997 which designated the United States of America.

BACKGROUND OF THE INVENTION

1. Field of the Invention

The present invention relates to a game card which comprises a plurality of pieces of information entering space with frames, such as a positional specific information entering space, a player's specific information entering space, a digital information entering space, an analog information entering space and the like, and which is used for playing a game on the basis of the information entered in the plurality of pieces of information entering space of the card dealt to a plurality of players.

The game card is used as a card for a sympathetic game (in other words, a resonance game or a synchronization game), for example, in which a degree of sympathy (in other words, resonance or synchronization) of the mutual digital information entered in the plurality of pieces of digital information entering space by a plurality of players to whom the game cards are dealt and a degree of sympathy (or resonance) of the mutual analog information entered in the plurality of pieces of the analog information entering space thereby are estimated by giving points.

2. Description of the Background Art

Conventionally, there has been no game card which comprises a plurality of pieces of information entering space with frames, such as a positional specific information entering space, a player's specific information entering space, a digital information entering space, an analog information entering space and the like, and which is used for playing a game on the basis of the information entered in the plurality of pieces of the information entering space of the cards dealt to a plurality of players, especially, for enjoying a psychological sympathy (or resonance) of a plurality of players, or the like.

SUMMARY OF THE INVENTION

An object of the present invention is to provide a novel game card which enables a plurality of players to enjoy a game on the basis of the information entered by the players in the plurality of pieces of information entering space of the cards dealt to the players, for example, a novel card for a sympathetic game (or a resonance game) or the like, which has not existed, and which enables the players to enjoy a psychological sympathetic game (or a psychological resonance game).

In order to accomplish the above-described object, the inventor considered a novel game card, such as a card for a sympathetic game, which enables a plurality of players to enjoy a game on the basis of the information entered by the players in the plurality of pieces of the information entering space of the cards dealt to the players. As a result, the present invention was completed.

That is, in accordance with one aspect of the present invention, the game card comprises; a positional specific information entering space with a frame, for entering a positional information for specifying a player's position, a player's specific information entering space with a frame, for entering a player's specific information for specifying the player, a digital information entering space with a frame in which a plurality of written Information are provided, for optionally selecting an information from among them, and an analog information entering space with a frame, for entering an information which optionally occurs to the player.

In such a game card, because a positional specific information entering space with a frame, for entering a positional information for specifying a player's position, a player's specific information entering space with a frame, for entering a player's specific information for specifying the player, a digital information entering space with a frame in which a plurality of written information are provided, for optionally selecting an information from among them, and an analog information entering space with a frame, for entering an information which optionally occurs to the player, the players can enjoy novel, interesting and various games, such as a psychological game. which have not ever been played, when the game cards are dealt to a plurality of players one by one, each player enters information in the plurality of pieces of information entering space of the dealt game card and then the game cards are collected, and the information entered in the plurality of pieces of information entering space of the plurality of collected game cards are compared with each other.

In accordance with another aspect of the present invention, the game card comprises: a positional specific information entering space with a frame, a player's specific information entering space with a frame, a digital information entering space with a frame and an analog information entering space with a frame, wherein the game card is used for playing a game in which the game cards are dealt to a plurality of players one by one; each player enters a positional information for specifying a position of the each player in the positional specific information entering space, enters a player's specific information for specifying the player in the player's specific information entering space, enters an information selected from among a plurality of written information predetermined as selective information in the digital information entering space and enters an information which optionally occurs to the player in the analog information entering space, and then the game cards are collected; the plurality of collected game cards are arranged in accordance with the positional information entered in the positional specific information entering space; and a degree of sympathy between one digital information entered in one game card and another digital information entered in another game card which is arranged around the one game card, and a degree of sympathy between one analog information entered in one game card and another analog information entered in another game card which is arranged around the one game card are estimated by giving points.

In such a game card, a positional specific information entering space with a frame, a player's specific information entering space with a frame, a digital information entering space with a frame and an analog information entering space with a frame are provided. Each player can recognize the difference in a degree of sympathy or the like, so that the players can enjoy a novel and interesting psychological game which has not ever been played, when the game card is used for playing a game in which the game cards are dealt to a plurality of players one by one; each player enters a positional information for specifying a player's position in the positional specific information entering space with a frame, enters a player's specific information for specifying the player in the player's specific information entering space with a frame, enters an information selected from among a plurality of written information predetermined as selective information in the digital information entering space with a frame and enters an information which optionally occurs to the player in the analog information entering space with a frame, and then the game cards are collected; the plurality of collected game cards are arranged in accordance with the positional information entered in the positional specific information entering space; and a degree of sympathy between one digital information entered in one game card and another digital information entered in another game card which is arranged around the one game card, and a degree of sympathy between one analog information entered in one game card and another analog information entered in another game card which is arranged around the one game card are estimated by giving points.

In the positional specific information entering space with a frame, not only the player's seat number but also any positional specific information which can specify a player's spatial position may be entered. In the player's specific information entering space with a frame, not only the player's (the game member's) name but also any information which can specify the player, such as a nickname, a number, an alphabet character or the like, may be entered. In the digital information entering space with a frame, any digital information, such as a numeral, a katakana, a hiragana, an alphabet character, a mark, a Chinese character or the like, may be entered. The number of pieces of the digital information entering space with frames may be one or more. In the analog information entering space with a frame, any analog information, such as a figure, a picture, a sentence or the like, may be entered. The number of pieces of the analog information entering space with frames may be one or more.

In the game card, a trial number identifying information entering space with a frame, which is not indispensable to the game card, for entering the number of trials may be provided.

It is preferable to provide a connecting part which is not indispensable, for connecting one game card with another at the end of the game card. The connecting part preferably comprises a first protrusion having a shape broadened toward a free end thereof, which is formed on one of upper and lower ends of the game card; a first recess having a shape corresponding to that of the first protrusion, which is formed at a position corresponding to that of the first protrusion, on the other of the upper and lower ends; a second protrusion having a shape broadened toward a free end thereof, which is formed on one of right and left ends of the game card; a second recess having a shape corresponding to that of the second protrusion, which is formed at a position corresponding to that of the second protrusion on the other of the right and left ends thereof.

Because such a connecting part is provided at the end portion of the game card, a lot of game cards collected from each player can be connected like a plain coordinate in accordance with the player's spatial positional information (e.g., seat number) and the game sheet can be made quickly and securely so as not to break it. As a result, each player's score or the like can be calculated rapidly and reliably.

DETAILED DESCRIPTION OF THE PREFERRED EMBODIMENT

A card for a sympathetic game (in other words, a resonance game or a synchronization game) according to an embodiment of the present invention and a sympathetic game (or a resonance game) in which the card for a sympathetic game (or a resonance game) is used will be explained with reference to the accompanying drawings, as follows.

Figure 1:
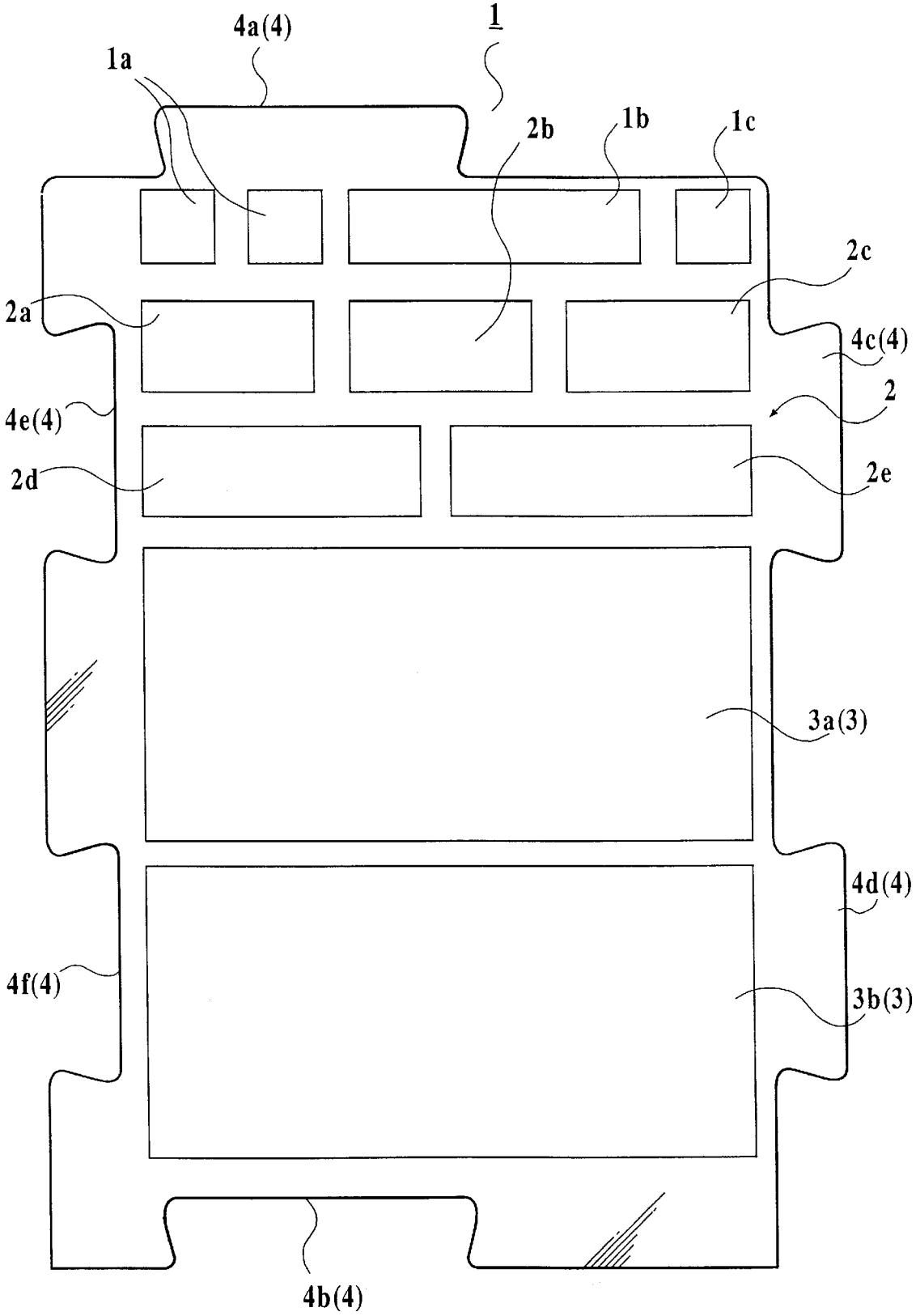
FIG. 1 is a plan view of the card for a sympathetic game.
Figure 2:
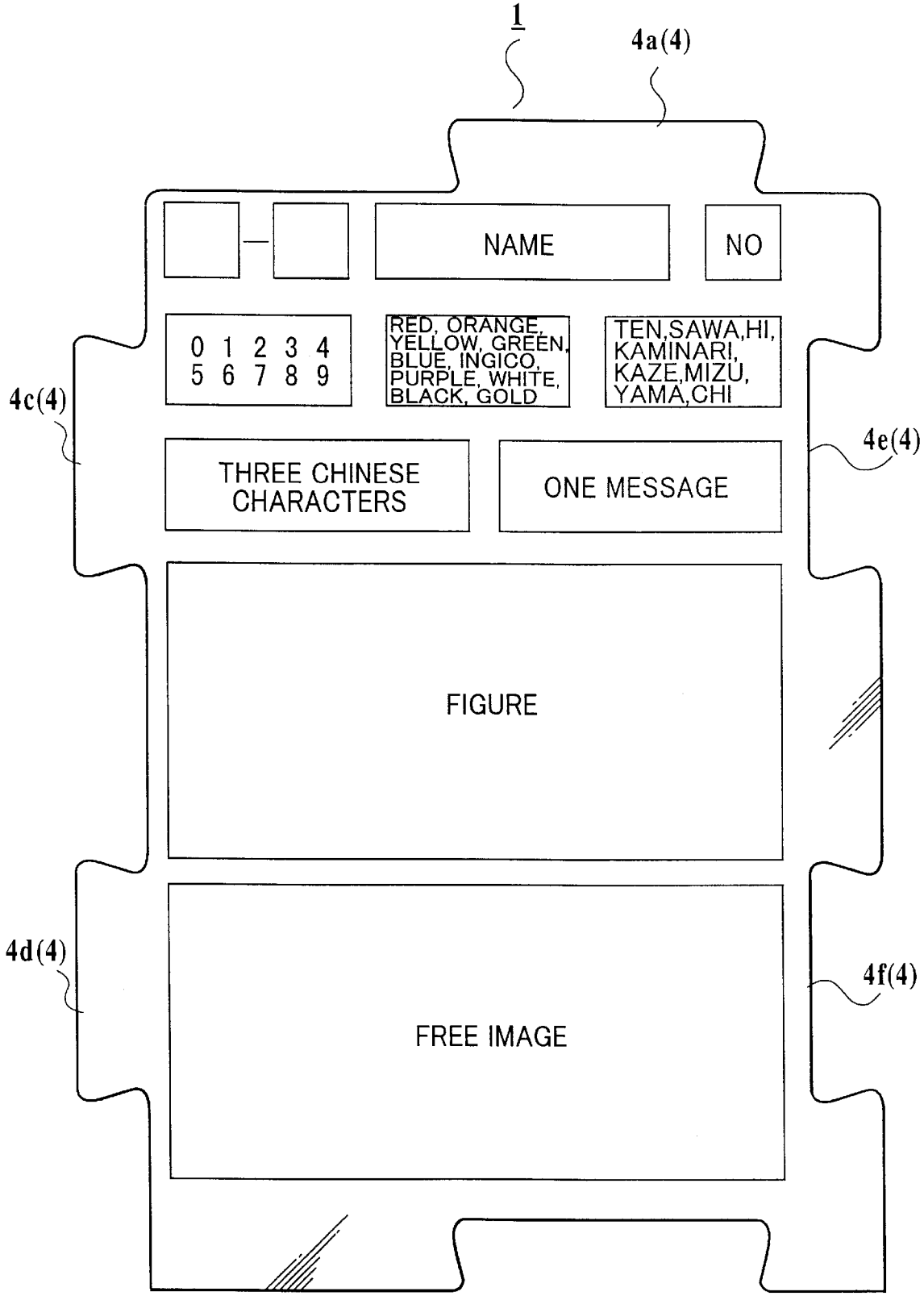
FIG. 2 is a bottom view of the card for a sympathetic game.
Figure 3:
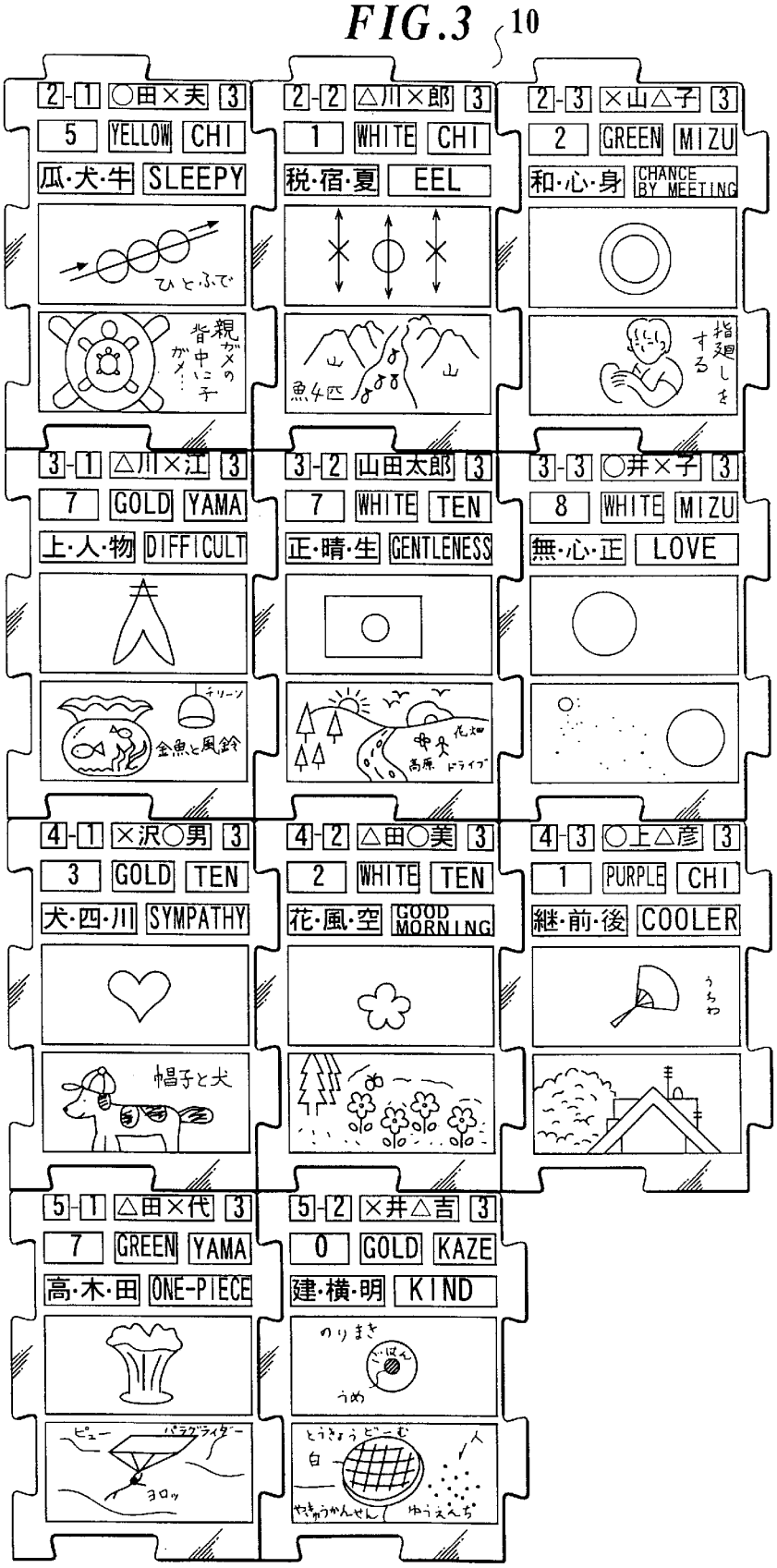
FIG. 3 is a plan view showing a state that the cards for a sympathetic game, in which necessary items are entered are connected to each other in accordance with the player's seat number.

FIG. 1 is a plan view of the card for a sympathetic game, FIG. 2 is a bottom view thereof, and FIG. 3 is a plan view showing a state that the cards for a sympathetic game, in which necessary items are entered are connected to each other in accordance with the player's seat number.

On the front surface of the card 1 for a sympathetic game, a positional specific information entering space 1*a* with frames, a player's specific information entering space 1*b* with a frame, a trial number identifying information entering space 1*c* with a frame, a plurality of pieces of digital information entering space 2 with frames, a plurality of pieces of analog information entering space 3 with frames and the like are provided. On the other hand, in the rear surface of the card 1 for a sympathetic game, the items to be entered in each space corresponding to the positional specific information entering space 1*a* with frames, the player's specific information entering space 1*b* with a frame, the trial number identifying information entering space 1*c* with a frame, a plurality of pieces of the digital information entering space 2 with frames, a plurality of pieces of the analog information entering space 3 with frames and the like, of the front surface thereof are entered.

Further, connecting parts 4 for connecting one card 1 for a sympathetic game with another card 1 for a sympathetic game are provided at the upper and lower ends and the right and left ones of each card 1.

The positional specific information entering space 1*a* comprises a plurality of pieces of space with frames, in which an information for specifying a spatial position, such as each player's seat number, is entered. For example, when there is a player's seat in the fourth row from the front and in the third line from the left, the player enters the information "4-3" therein.

The player's specific information entering space 1*b* is a space with a frame, in which an information for specifying each player is entered. In the space 1*b*, the player enters, for example, his or her name as an item to be entered, as shown in FIG. 2 (or the player may also enter his or her nickname or the like).

The trial number information entering space 1*c* is a space with a frame, in which the number of trials of the game is entered. In the space 1*c*, as a trial NO. shown in FIG. 2, the player enters the number of trials of the game.

The digital information entering space 2 comprises a plurality of pieces of space with frames, in which a player enters an information optionally selected from among a plurality of predetermined information. In the embodiment, five pieces of digital information entering space 2*a*, 2*b*, 2*c*, 2*d* and 2*e* are provided.

Among five pieces of space, in the first digital information entering space 2*a* with a frame, for example, as shown in FIG. 2, the player can optionally select a numeral from among the predetermined numerals [0, 1, 2 . . . 9], and then the player enters the selected numeral.

In the second digital information entering space 2*b* with a frame, for example, as shown in FIG. 2, the player can optionally select color from among the predetermined ten colors [red, orange, yellow, green, blue, indigo, purple, white, black and gold], and then the player enters the selected color.

In the third digital information entering space 2*c* with a frame, for example, as shown in FIG. 2, the player can optionally select a word from among the predetermined eight words [Ten (heaven), Sawa (swamp), Hi (fire), Kaminari (thunder), Kaze (wind), Mizu (water), Yama (mountain) and Chi (earth)], and then the player enters the selected word.

In the fourth digital information entering space 2*d* with a frame, the player can freely select three Chinese characters, and then the player enters the three Chinese characters.

In the fifth digital information entering space 2*e* with a frame, the player enters one message which occurs to the player inspiredly.

The analog information entering space 3 comprises two pieces of space with frames, in which the player enters optional analog information. In the embodiment, the first analog information entering space 3*a* with a frame and the second analog information entering space 3*b* with a frame are provided.

Between two pieces of space, in the first analog information entering space 3*a* with a frame, the player enters an optional geometric analog information (an abstract analog information) which occurs to the player, for example, a figure or the like.

In the second analog information entering space 3*b* with a frame, the player enters an optional pictorial analog information (a concrete information of a free image) which occurs to the player, for example, a picture of a scene, an animal, a plant or the like.

The connecting part 4 comprises, for example, a protrusion 4*a* having a shape broadened toward a free end thereof which is formed on the upper end, a recess 4*b* having a shape corresponding to that of the protrusion 4*a,* which is formed at a position corresponding to the protrusion 4*a,* on the lower end, two protrusions 4*c* and 4*d* having a shape broadened toward a free end thereof which are formed on the right end, and two recesses 4*e* and 4*f* having a shape corresponding to that of the protrusions 4*c* and 4*d,* which are formed at positions corresponding to the protrusions 4*c* and 4*d,* on the left end, respectively.

Next, an example of a sympathetic game in which the plurality of cards 1 for a sympathetic game, which are constituted as described above are used will be explained.

Before playing the sympathetic game, not only game members but also a master, a checker, an analyst and the like are decided.

The members are participants in the sympathetic game and do not require an elementary knowledge or a preliminary experience about the sympathetic game.

A role of the master is to explain the rules of the sympathetic game to the members, to properly advise the members on the sympathetic game in the neutral position and to manage the game so that the members can have a significant experience. The master calls a start and an end of the game, and clarifies a time for playing game.

A role of the checker is to point out the sympathetic phenomenon.

A role of the analyst is to analyze and explain the sympathetic phenomenon.

In case of necessity, the checker can also serve as the analyst.

The place for playing the sympathetic game is, as a whole, called "field". The whole place in which the members are seated is called "area". The area consists of a group of seats having a certain arrangement.

For example, the rules and regulations of the game are provided as follows.

1) The number of members requires two or more.
2) It is preferable that the master does not serve as the checker or the analyst. A member cannot serve as the master, the checker or the analyst.
3) In principle, the master, the checker and the analyst cannot intend the members to sympathize with each other or to interfere with each other at all.
4) The master decides the arrangement in the area in accordance with the setting situation of the field and the number of members.
5) Generally, the shape of the whole area is called "area shaped". A typical area shape is a rectangle or an ellipse. When the area shape is a rectangle, in general, the members enter the information while they face toward a certain direction. In the case of an ellipse, it is possible to arrange the members in two ways in which the members are seated face to face and back to back.
6) The master decides necessary items (which are called "game menu" or "menu", simply) to be entered in the card for the sympathetic game, a timing for entering the menus and how long it takes to enter the menus, in accordance with the advocate's opinions.
7) In general, when the trials are played repeatedly, it is preferable to change seats. In the case of changing seats, it is preferable to follow a predetermined rule.
8) A positive trial is a way in which each member enters the menus so as to increase the score on the trial as much as possible. A negative trial is a way in which each member enters the menus so as to decrease the score on the trial as much as possible. A neutral trial is a way in which each member enters the menus purely so as not to consider the score.
9) In general, it is preferable that at the start of the game, the members play the game on the neutral trial so as to accustom the members to it, and then the members play the game on the positive trial or on the negative trial, alternatively.
10) When the ranking list is made, in general, the total score is obtained so as to add the score got on the positive trial (or on the neutral trial, in case of necessity) and so as to subtract the score got on the negative trial.
11) A bonding unit for bonding two pieces of information which are coincident with each other or which sympathize with each other is called "bond". The types of bond are classified on the basis of the menu and the spatial distance at which two pieces of information can sympathize with each other.
12) A score is given to each member in each bond. With relation to the score, it is standardized that 1 point is given to each member in the neighboring sympathy (in other words, resonance or synchronization) and 0.5 point is done in the distant sympathy. As a rare case (a rare sympathy), it is estimated that the checker's or the analyst's information is coincident with a participant's. When the master recognizes the coincidence as a rare case, the master can give 2 points to the participant. On the negative trial, the rule of the rare case is predetermined in each game.

13) When participants are commended for playing game, it is preferable to commend both a participant who gets the best score and one who gets the worst score.

14) The master can order a member who is likely to prevent the smooth process of the game to go out of the game, or can direct the member to look at the game from the outside.

15) The card for the sympathetic game, a table for arranging the cards and the above-mentioned bond, which are specially planned, set up and designed by the advocate are used.

16) In the process of the game, the spatial area in which the remarkable sympathetic phenomenon is observed is called "sympathetic zone". Further, two persons or a group, to whom the remarkable sympathy occurs is called "sympathetic couple" or "sympathetic group".

In the sympathetic game, the game master decides a spatial position (for example, a seat number) of each player, and then deals the cards 1 for the sympathetic game to each player one by one.

Next, the master lets each player enter a player's spatial positional information (for example, a seat number) in the positional specific information entering space 1*a* with a frame, enter an information (for example, a player's name) for specifying each player in the player's specific information entering space 1*b* with a frame and enter the number of trials in the trial number identifying information entering space 1*c* with a frame, of the dealt card 1 for the sympathetic game, respectively.

Further, the master lets each player enter one numeral optionally selected by each player from among the numerals [0, 1, 2 . . . 9] in the first digital information entering space 2*a* with a frame, enter one color optionally selected by each player from among ten colors [red, orange, yellow, green, blue, indigo, purple, white, black and gold] in the second digital information entering space 2*b* with a frame and enter one word optionally selected by each player from among the words [Ten (heaven), Sawa (swamp), Hi (fire), Kaminari (thunder), Kaze (wind), Mizu (water), Yama (mountain) and Chi (earth)] in the third digital information entering space 2*c* with a frame, among several pieces of digital information entering space 2, respectively.

Furthermore, the master lets each player enter the first analog information (for example, an abstract pattern, such as a relatively simple figure, a mark or the like) in the first analog information entering space with a frame and enter the second analog information (for example, a concrete pattern, such as a picture or the like) in the second analog information entering space with a frame, between two pieces of analog information entering space 4, respectively.

When the above information is entered in a plurality of pieces of space, the players are careful so as not to show the information to each other.

After the players enter the information, the checker collects all of the player's cards 1 for the sympathetic game. As shown in FIG. 3, a game sheet (also referred to a game board) is made quickly by connecting the collected cards 1 for the sympathetic game with each other in accordance with the player's spatial positional information (for example, a seat number) entered in the positional specific information entering space 1*a*.

Subsequently, the checker points out the sympathetic phenomenon concretely, while the checker shows the made game sheet to the game members or the like.

The checker gives the bonded unit called "bond" to the game sheet in accordance with the above predetermined rules and regulations in order to estimate each sympathetic phenomenon. Types of the bonds are different in a degree of sympathy (in other words, resonance or synchronization), and the points are given to the game members in each bond. The total score given to one member in the bonds is called one member's "score".

The analyst analyzes the sympathetic phenomenon pointed out by the checker and estimates it by giving points, while the analyst discusses it with all of the members smoothly. Further, the analyst makes an effort to naturally obtain all of the members' approval on the analyst's operation. Each member has a chance to understand the conscious phenomenon more through the process.

The above-described series of process is called "trial". The trial can be carried out repeatedly.

There are three types of trials, which are called "positive trial" (simply, referred to "positive"), "negative trial" (simply, referred to "negative") and "neutral trial" (simply, referred to "neutral"). Three trials are defined by the above-described rules and regulations.

Subsequently, the master estimates a degree of sympathy by giving points, for example, under the following criteria.

An example of the estimation will be explained with reference to FIG. 3, as follows.

It will be explained how to estimate a degree of sympathy by giving points, for example, "Yamada Taro" of whom seat number is "3-2" (the seat position which is in the third row from the front and in the second line from the left). Because the negative is considered, the estimation becomes complex. In this case, the estimation is carried out without the negative.

In the case of information entered in the first digital information entering space 2*a,* the sympathy between one member and others sitting directly in front of, directly behind, on the immediate left of and on the immediate right of the one member, is estimated. Further, the sympathy between the one member and others sitting diagonally in front of the one member to the left, diagonally in front of the one member to the right, diagonally behind the one member to the left and diagonally behind the one member to the right is estimated. The sympathy between two members who are apart from each other is not estimated.

In "Yamada Taro"'s first digital information entering space, the numeral "7" is entered. The numeral "7" is only sympathized with the same numeral entered in the first digital information entering space 2*a* by the member sitting on the immediate left of "Yamada Taro", so that "Yamada Taro" obtains "+1 point" by the sympathy of the numeral entered in the first digital information entering space 2*a*.

In the case of information entered in the second digital information entering space 2*b,* the sympathy between one member and others sitting directly in front of, directly behind, on the immediate left of and on the immediate right of the one member, is estimated. Further, the sympathy between the one member and others sitting diagonally in front of the one member to the left, diagonally in front of the one member to the right, diagonally behind the one member to the left and diagonally behind the one member to the right is estimated.

In "Yamada Taro"'s second digital information entering space 2*b,* the word "white" is entered. The word "white" is coincident with the same word entered in the second digital information entering space 2*b* by the members sitting directly in front of, on the immediate right of and directly behind "Yamada Taro", so that "Yamada Taro" obtains "+3 points" by the sympathy of the word entered in the second digital information entering space 2*b*.

In the case of information entered in the third digital information entering space 2*c,* the sympathy between one member and others sitting directly in front of, directly behind, on the immediate left of and on the immediate right of the one member, is estimated. Further, the sympathy between the one member and others sitting diagonally in front of the one member to the left, diagonally in front of the one member to the right, diagonally behind the one member to the left and diagonally behind the one member to the right is estimated.

In "Yamada Taro"'s third digital information entering space 2*c,* the word "Ten (heaven)" is entered. The word "Ten (heaven)" is coincident with the same word entered in the third digital information entering space 2*c* by the members sitting directly behind "Yamada Taro" and sitting diagonally behind "Yamada Taro" to the left, so that "Yamada Taro" obtains "+2 points" by the sympathy of the word entered in the third digital information entering space 2*c*.

In the case of information entered in the fourth digital information entering space 2*d,* in the case of an example of the arrangement, the sympathy between one member and others sitting directly in front of, directly behind, two rows behind, on the immediate left of, and on the immediate right of the one member, is estimated. Further, the sympathy between the one member and others sitting diagonally in front of the one member to the left, diagonally in front of the one member to the right, diagonally behind the one member to the left, diagonally behind the one member to the right and on the immediate left of the member sitting two rows behind the one member, is estimated.

In "Yamada Taro"'s fourth digital information entering space 2*d,* the three characters "Sei (correct), Sei (fine) and Sei (life)" are entered. The character "Sei (correct)" is only coincident with one character "Sei (correct)" among three characters entered in the fourth digital information entering space 2*d* by the member sitting on the immediate right of "Yamada Taro", so that "Yamada Taro" obtains "+1 point" by the sympathy of the character entered in the fourth digital information entering space 2*d.*

In the case of information entered in the fifth digital information entering space 2*e,* in the case of an example of the arrangement, the sympathy between one member and others sitting directly in front of, directly behind, two rows behind, on the immediate left of, and on the immediate right of the one member, is estimated. Further, the sympathy between the one member and others sitting diagonally in front of the one member to the left, diagonally in front of the one member to the right, diagonally behind the one member to the left, diagonally behind the one member to the right and on the immediate left of the member sitting two rows behind the one member, is estimated.

In "Yamada Taro"'s fifth digital information entering space 2*e,* one message "gentleness" is entered. However, in other members' fifth digital information entering space 2*e* for estimating the sympathy, one message to be sympathized with it is not entered, so that "Yamada Taro" obtains "no points" by the sympathy of the one message entered in the fifth digital information entering space 2*e*.

In the case of information entered in the first analog information entering space 3*a,* the sympathy between one member and others sitting directly in front of, directly behind, on the immediate left of and on the immediate right of the one member, is estimated. Further, the sympathy between the one member and others sitting diagonally in front of the one member to the left, diagonally in front of the one member to the right, diagonally behind the one member to the left and diagonally behind the one member to the right is estimated. As sympathetic criteria, when there is a community of an appearance, a name, a concept or the like in the whole figure or in a part of the figure entered in the first analog information entering space 3*a,* the community is judged to sympathize with each other.

In "Yamada Taro"'s first analog information entering space 3*a,* "a figure showing a circle in a quadrilateral" is entered. A circle shown in this figure corresponds with one in a part of figure entered in the first analog information entering space 3*a* by the members sitting directly in front of and on the immediate right of "Yamada Taro", and sitting diagonally in front of "Yamada Taro" to the left and diagonally in front of "Yamada Taro" to the right, so that "Yamada Taro" obtains "+4 points" by the sympathy in the first analog information entering space 3*a*.

In the case of information entered in the second analog information entering space 3*b,* the sympathy between one member and others sitting directly in front of, directly behind, on the immediate left of and on the immediate right of the one member, is estimated. Further, the sympathy between the one member and others sitting diagonally in front of the one member to the left, diagonally in front of the one member to the right, diagonally behind the one member to the left and diagonally behind the one member to the right is estimated. As sympathetic criteria, when there is a community of an appearance, a name, a concept or the like in the whole figure or in a part of the figure entered in the second analog information entering space 3*b,* the community is judged to sympathize with each other.

In "Yamada Taro"'s second analog information entering space 3*b,* "a picture showing a mountain, a round sun, a road, a flower garden, a tree and a bird" is entered. In the picture, "a picture of mountain" corresponds with one entered in the second analog information entering space 3*b* by the member sitting directly in front of "Yamada Taro", "a picture of a flower garden" corresponds with one entered in the second analog information entering space 3*b* by the member sitting directly behind "Yamada Taro", "a picture of a round sun" corresponds with "a picture of a circle" entered in the second analog information entering space 3*b* by the member sitting on the immediate right of "Yamada Taro", and "a picture of a tree" corresponds with one entered in the analog information entering space 3*a* by the member sitting diagonally behind "Yamada Taro" to the right, respectively. As a result, "Yamada Taro" obtains "+4 points" by the sympathy in the second analog information entering space 3*b.*

Therefore, in this trial, "Yamada Taro"'s score obtains "15 points".

In the same way, all of the members' scores are calculated, and then the ranking list is made.

As a result of making the list, a difference in a degree of sympathy between the members is recognized.

Then, after the members change the seats, the trial is carried out in the same way and the scores are calculated so as to make the ranking list, again.

When the trial is carried out by dividing the members into a plurality of groups, the total score of each group is calculated and the ranking list of each group is also made.

After the trial is carried out several times in the above-described way, the ranking list of each person and that of each group are made in each trial.

Because of the ranking list made in the above-described way, the difference in a degree of sympathy (a degree of similarity or a degree of approximation) of each member's idea between one person and another or between one group and another is recognized. By commending a member or a group in accordance with the above-described rules and regulations or the like, the novel psychological game which has not ever been played can be enjoyed.

In the above example of the game, the negative is not included. However, when the negative is included, the game becomes more interesting.

An estimation of a degree of sympathy is not limited to the relation between the above-described seat positions or to the above-described way to give points, and any estimation may be decided in the game regulation.

In the positional specific information entering space 1*a* with a frame, not only the player's seat number but also any positional specific information which can specify a player's spatial position may be entered. In the player's specific information entering space 1*b* with a frame, not only the player's (game member's) name but also any information which can specify the player, such as a nickname, a number, an alphabet character or the like, may be entered. In the digital information entering space 2 with a frame, any digital information, such as a numeral, a katakana, a hiragana, an alphabet character, a mark, a Chinese character or the like, may be entered. The number of pieces of digital information entering space 2 with a frame may be one or more. In the analog information entering space 3 with a frame, any analog information, such as a figure, a picture, a sentence or the like, may be entered. The number of pieces of analog information entering space 3 with a frame may be one or more.

Further, the game regulations are not limited to the above-described rules and regulations. If the game regulations have a content in which a difference in a degree of sympathy of each player can be measured, any modification thereof may be made.

According to the present Invention, In a card for a sympathetic game, a positional specific information entering space with a frame, a player's claim specific information entering space with a frame, a digital information entering space with a frame and an analog information entering space with a frame are provided. Each player can recognize the difference in a degree of sympathy or the like, so that the players can enjoy a novel and interesting psychological game which has not ever been played, when the game card is used for playing a game in which the game cards are dealt to a plurality of players one by one; each player enters a positional information for specifying a player's position in the positional specific information entering space, enters a player's specific information for specifying the player in the player's specific information entering space, enters an information selected from among a plurality of pieces of written information predetermined as selective information in the digital information entering space and enters an information which optionally occurs to the player in the analog information entering space, and then the game cards are collected; the plurality of collected game cards are arranged in accordance with the positional information entered in the positional specific information entering space with a frame; and a degree of sympathy between the digital information entered in one game card and another digital information entered in another game card which is arranged around the one game card, and a degree of sympathy between the analog information entered in one game card and another analog information entered in another game card which is arranged around the one game card are estimated by giving points.

What is claimed is:

1. A plurality of game cards, each comprising:

a positional specific information entering space with a frame, for entering a positional information for specifying a player's position, a player's specific information entering space with a frame, for entering a player's specific information for specifying the player, a first digital information entering space with a frame, having ten first objects to be selected, for optionally selecting one first object to be selected from among the ten first objects to be selected, the first objects being numerals, a second digital information entering space with a frame, having ten second objects to be selected, for optionally selecting one second object to be selected from among the ten second objects to be selected, the second objects being words indicative of colors, a third digital information entering space with a frame, having eight third objects to be selected, for optionally selecting one third object to be selected from among the eight third objects to be selected, the third objects being words indicative of scenes, a fourth digital information entering space with a frame for entering a character which optionally occurs to the player, a fifth digital information entering space with a frame for entering a message which optionally occurs to the player, a first analog information entering space with a frame for entering a figure which optionally occurs to the player, and a second analog information entering space with a frame for entering a free image which optionally occurs to the player, wherein a degree of sympathy is evaluated by bonding one information entered in one card and another information entered in another card to give points to a player when one information entered in one card is coincident with another information entered in another card;

wherein all of the game cards are formed in a substantially same shape and each game card comprises a connecting part for connecting one game card with another at an end of each game card, wherein the connecting part comprises a first protrusion having a shape broadened toward a free end thereof, which is formed on one of upper and lower ends of each game card; a first recess having a shape corresponding to that of the first protrusion, which is formed at a position corresponding to that of the first protrusion, on the other of the upper and lower ends; a second protrusion having a shape broadened toward a free end thereof, which is formed on one of right and left ends of each game card; a second recess having a shape corresponding to that of the second protrusion, which is formed at a position corresponding to that of the second protrusion on the other of the right and left ends thereof.

2. The game card of claim 1, further comprising a trial number identifying information entering space with a frame, for entering an identifying information indicative of a number of trials.

3. A plurality of game cards, each comprising:

a positional specific information entering space with a frame, a player's specific information entering space with a frame, a first digital information entering space with a frame, having ten first objects to be selected, for optionally selecting one first object to be selected from among the ten first objects to be selected, the first objects being numerals, a second digital information entering space with a frame, having ten second objects to be selected, for optionally selecting one second object to be selected from among the ten second objects to be selected, the second objects being words indicative of colors, a third digital information entering space with a frame, having eight third objects to be selected, for optionally selecting one third object to be selected from among the eight third objects to be selected, the third objects being words indicative of scenes, a fourth digital information entering space with a frame, for entering a character which optionally occurs to the player, a fifth digital information entering space with a frame, for entering a message which optionally occurs to the player, a first analog information entering space with a frame, for entering a figure which optionally occurs to the player, and a second analog information entering space with a frame, for entering a free image which optionally occurs to the player, wherein the plurality of game cards are used for playing a game in which the game cards are dealt to a plurality of players one by one;

each player enters a positional information for specifying a position of the each player in the positional specific information entering space, enters a player's specific information for specifying the player in the player's specific information entering space, selects one first object to be selected from among the ten first objects to be selected in the first digital information entering space, selects one second object to be selected from among the ten second objects to be selected in the second digital information entering space, selects one third object to be selected from among the eight third objects to be selected in the third digital information entering space, enters a character which optionally occurs to the player in the fourth digital information entering space, enters a message which optionally occurs to the player in the filth digital information entering space, enters a figure which optionally occurs to the player in the first analog information entering space and enters a free image which optionally occurs to the player in the second analog information entering space, and then the game cards are collected;

the plurality of collected game cards are arranged in accordance with the positional information entered in the positional specific information entering space, wherein a degree of sympathy between one first object selected in one game card and another first object selected in another game card which is arranged around the one game card, a degree of sympathy between one second object selected in one game card and another second object selected in another game card which is arranged around the one game card, a degree of sympathy between one third object selected in one game card and another third object selected in another game card which is arranged around the one game card, a degree of sympathy between one character entered in one game card and another character entered in another game card which is arranged around the one game card, a degree of sympathy between one message entered in one game card and another message entered in another game card which is arranged around the one game card, a degree of sympathy between one figure entered in one game card and another figure entered in another game card which is arranged around the one game card, and a degree of sympathy between one free image entered in one game card and another free image entered in another game card which is arranged around the one game card are evaluated by bonding one information entered in one card and another information entered in another card to give points to a player when one information entered in one card is coincident with another information entered in another card;

wherein all of the game cards are formed in a substantially same shape and each game card comproses a connecting part for connecting one game card with another ta an end of each game card, wherein the connecting part comprises a first protrusion having a shape broadened toward a free end thereof, which is formed on one of upper and lower ends of each game card; a first recess having a shape corresponding to that of the first protrusion, which is formed at a position corresponding to that of the first protrusion, on the other of the upper and lower ends; a second protrusion having a shape broadened toward a free end thereof, which is formed one of right and left ends of each game card; a second recess having a shape corresponding to that of the second protrusion, which is formed at a position corresponding to that of the second protrusion on the other of the right and left ends thereof.

4. The game card of claim 3, further comprising a trial number identifying information entering space with a frame, for entering an identifying information indicative of a number of trials.

5. A plurality of game cards, each comprising:

a positional specific information frame space for entering positional information of a player with respect to other players;

a player specific information frame space for entering player specific information identifying the player;

a first information frame space having ten first objects to be selected, for optionally selecting one first object to be selected from among the ten first objects to be selected, the first objects being numerals, a second information frame space having ten second objects to be selected, for optionally selecting one second object to be selected from among the ten second objects to be selected, the second objects being words indicative of colors, a third information frame space having eight third objects to be selected, for optionally selecting one third object to be selected from among the eight third objects to be selected, the third objects being words indicative of scenes, a fourth information frame space for entering a character which optionally occurs to the player, a fifth information frame space for entering a message which optionally occurs to the player, a sixth information frame space for entering a figure which optionally occurs to the player, a seventh information frame space for entering a free image which optionally occurs to the player, and interlocking connectors for connecting the game card with other game cards, wherein a degree of sympathy is evaluated by bonding one information entered in one card and another information entered in another card to give points to a player when one information entered in one card is coincident with another information entered in another card;

wherein all of the game cards are formed in a substantially same shape and the interlocking connectors comprise a protrusion extending from a first end of each game card for interlocking with a corresponding mating recess on a respective opposite second end of another game card and a recess formed at a position corresponding to that of the protrusion along an opposite second end of each game card for interlocking with a corresponding protrusion on a respective first end of another game card.

6. The game card of claim 5, wherein the protrusion has a shape broadened toward a free end thereof and the recess has a shape corresponding to that of the protrusion.

7. The game card of claim 5, wherein said interlocking connectors comprise a plurality of protrusions extending from the game card and a plurality of recesses formed along edges of the game card, the plurality of protrusions interlocking with corresponding mating recesses of other game cards and the plurality of recesses interlocking with corresponding mating protrusions of other game cards.

8. The game card of claim 5, further comprising a trial number identifying information frame space for entering trial information indicative of a number of trials to be performed.

9. A plurality of game cards adapted for a sympathetic game, each comprising:

a positional specific information entering space with a frame, for entering a positional information for specifying a player's position;

a player's specific information entering space with a frame, for entering a player's specific information for specifying the player;

a first digital information entering space with a frame, having ten first objects to be selected, for optionally selecting one first object to be selected from among the ten first objects to be selected, the first objects being numerals, a second digital information entering space with a frame, having ten second objects to be selected, for optionally selecting one second object to be selected from among the ten second objects to be selected, the second objects being words indicative of colors, a third digital information entering space with a frame, having eight third objects to be selected, for optionally selecting one third object to be selected from among the eight third objects to be selected, the third objects being words indicative of scenes, a fourth digital information entering space with a frame, for entering a character which optionally occurs to the player, a fifth digital information entering space with a frame, for entering a message which optionally occurs to the player, a first analog information entering space with a frame, for entering a figure which optionally occurs to the player, and a second analog information entering space with a frame, for entering a free image which optionally occurs to the player, wherein the sympathetic game is conducted by distributing a different one of the plurality of game cards to each of a plurality of players one by one, each of the players filling in the positional information entering space, the specific information entering space, the first digital information entering space, the second digital information entering space, the third digital information entering space, the fourth digital information entering space, the fifth digital information entering space, the first analog information entering space and the second analog information entering space, arranging the filled game cards in accordance with the respective entered positional information, and determining a first degree of sympathy between one first object selected in one game card and another first object selected in another game card, a second degree of sympathy between one second object selected in one game card and another second object selected in another game card, a third degree of sympathy between one third object selected in one game card and another third object selected in another game card, a fourth degree of sympathy between one character entered in one game card and another character entered in another game card, a fifth degree of sympathy between one message entered in one game card and another message entered in another game card, a sixth degree of sympathy between one figure entered in one game card and another figure entered in another game card, and a seventh degree of sympathy between one free image entered in one game card and another free image entered in another game card by bonding one information entered in one card and another information entered in another card to give points to a player when one information entered in one card is coincident with another information entered in another card;

wherein all of the game cards are formed in a substantially same shape and each game card comprises a connecting part for connecting one game card with another at an end of each game card, wherein the connecting part comprises a first protrusion having a shape broadened toward a free end thereof, which is formed on one of upper and lower ends of each game card; a first recess having a shape corresponding to that of the first protrusion, which is formed at a position corresponding to that of the first protrusion, on the other of the upper and lower ends; a second protrusion having a shape broadened toward a free end thereof, which is formed on one of right and left ends of each game card; a second recess having a shape corresponding to that of the second protrusion, which is formed at a position corresponding to that of the second protrusion on the other of the right and left ends thereof.

10. The plurality of game cards of claim 9, wherein the character is a Chinese character.

* * * * *